US008449322B2

(12) United States Patent
Cai

(10) Patent No.: US 8,449,322 B2
(45) Date of Patent: May 28, 2013

(54) ELECTRICAL CONNECTOR

(75) Inventor: You Hua Cai, Guangzhou (CN)

(73) Assignee: Lotes Co., Ltd, Keelung (TW)

( * ) Notice: Subject to any disclaimer, the term of this patent is extended or adjusted under 35 U.S.C. 154(b) by 61 days.

(21) Appl. No.: 13/277,704

(22) Filed: Oct. 20, 2011

(65) Prior Publication Data

US 2013/0040496 A1 Feb. 14, 2013

(30) Foreign Application Priority Data

Aug. 11, 2011 (CN) ..... 2011 2 0290593 U

(51) Int. Cl.
*H01R 13/60* (2006.01)
*H01R 12/16* (2006.01)

(52) U.S. Cl.
CPC ..... *H01R 23/7073* (2013.01)
USPC ..... 439/541.5; 439/637

(58) Field of Classification Search
USPC ..... 439/541.5, 637, 631, 941, 626, 636, 439/79, 540.1, 733.1
See application file for complete search history.

(56) References Cited

U.S. PATENT DOCUMENTS

| | | | | |
|---|---|---|---|---|
| 5,221,212 | A * | 6/1993 | Davis | 439/108 |
| 5,336,109 | A * | 8/1994 | Hillbish et al. | 439/541.5 |
| 6,767,224 | B2 * | 7/2004 | Wu | 439/79 |
| 7,938,651 | B2 * | 5/2011 | Hanyu et al. | 439/79 |
| 2004/0115969 | A1 * | 6/2004 | Jou | 439/79 |
| 2004/0242071 | A1 * | 12/2004 | Ito et al. | 439/608 |

* cited by examiner

*Primary Examiner* — Renee Luebke
*Assistant Examiner* — Harshad Patel
(74) *Attorney, Agent, or Firm* — Morris Manning & Martin LLP; Tim Tingkang Xia, Esq.

(57) ABSTRACT

An electrical connector includes: (a) an electrical connection base, in which a notch is opened forwards at a rear side of the electrical connection base, at least one protruding block, at least one first receiving hole, and at least two second receiving holes are opened forwards from the notch, (b) at least one first terminal, having a vertical first connecting portion correspondingly, and (c) at least two second terminals, each having a vertical second connecting portion correspondingly disposed in the notch. The protruding block has an increased thickness, thus effectively ensuring functions of the protruding block of protecting terminals, isolating the first connecting portion from the second connecting portion and avoiding short circuit between the first connecting portion and the second connecting portion.

10 Claims, 7 Drawing Sheets

ELECTRICAL CONNECTOR

CROSS-REFERENCE TO RELATED APPLICATION

This application claims priority of Chinese Patent Application No. 201120290593.1, filed on Aug. 11, 2011, entitled "Electrical Connector", by You Hua Cai, the disclosure of which is incorporated herein by reference in its entirety.

FIELD OF THE INVENTION

The present invention relates to an electrical connector, and more particularly to an electrical connector capable of avoiding short circuit between terminals.

BACKGROUND OF THE INVENTION

Generally, a personal computer has various functional modules for implementing various functions such as data storage, image and audio functions. The modules are generally inserted in a corresponding electrical connector as an electronic card, and are connected to a circuit board through the electrical connector. With the development of the high integration and miniaturization of electronic products and rapid development of computer technologies, the requirements for data transmission become increasingly higher, and the electrical connector is required to have an improved capability of data transmission, so the number of terminals must be greatly increased.

In the industry, a common electrical connector includes an insulating body, in which a card slot is opened at a front side of the insulating body, for inserting a butting electronic card, and at least one notch is opened at a rear side of the insulating body. Multiple conductive terminals are disposed inside the insulating body, each of the conductive terminals has a vertical connecting portion located in the notch, each of the connecting portions extends forwards to form a contact portion entering the card slot, and the two adjacent connecting portions are disposed in parallel. In order to meet the high requirements for the miniaturization and data transmission of the electrical connector, if a large number of the conductive terminals are installed in the insulating body without changing the space occupied by the insulating body, the distance between the connecting portions of two adjacent conductive terminals must be reduced. However, the following problems occur due to compact arrangement of the conductive terminals.

1. As the two adjacent connecting portions are located in the notch and are disposed in parallel, the distance between the two adjacent connecting portions is very small, and the two adjacent connecting portions are not isolated by other elements, short circuit may be caused due to contact of the two adjacent connecting portions, which severely affects the signal transmission performance of the electrical connector.

2. As the two adjacent connecting portions are not isolated by other elements, when the conductive terminal is installed to the insulating body or the electrical connector shakes due to an external force, the conductive terminal easily deflects and shakes laterally, thus resulting in damage of the conductive terminal and loss of the electrical conduction function.

To solve the above problems, currently, in a design in the industry, a protruding block extends from the notch of the insulating body and is disposed between the two adjacent connecting portions for isolating the two connecting portions, so as to solve the problem of short circuit.

Although the protruding block disposed in the electrical connector can avoid short circuit between the two adjacent connecting portions, due to the compact arrangement of the conductive terminals (the distance between two adjacent connecting portions is very small), a clearance reserved between the two connecting portions for forming the protruding block at the insulating body is also very small, so the formed protruding block is very thin, and when the conductive terminal deflects and shakes laterally due to a large external force, the connecting portions easily impact the protruding block, resulting in that the protruding block is broken since the protruding block is too thin to endure the force, and finally loses the function of avoiding short circuit.

Therefore, a heretofore unaddressed need exists in the art to design a novel electrical connector to address the aforementioned deficiencies and inadequacies.

SUMMARY OF THE INVENTION

The present invention is directed to an electrical connector capable of protecting terminals, preventing terminals from deflecting, and effectively avoiding short circuit between terminals.

To achieve the above objectives, the present invention adopts the following technical solution.

An electrical connector is provided, which includes: an electrical connection base, in which a notch is opened at a rear side of the electrical connection base, at least one protruding block protrudes backwards from the notch, at least one first receiving hole and at least two second receiving holes are opened forwards from the notch, and the at least two second receiving holes are located at two sides of the first receiving hole; at least one first terminal, having a vertical first connecting portion correspondingly disposed in the notch, in which the first connecting portion is bent backwards along a periphery of the protruding block to form a bending section, and a first contact portion extends forwards from the first connecting portion and is located in the first receiving hole; and at least two second terminals, each having a vertical second connecting portion correspondingly disposed in the notch, in which the second connecting portions of the two second terminals are correspondingly located at two sides of the protruding block, and a second contact portion extends forwards from the second connecting portion and is located in one of the second receiving holes.

Furthermore, at least one supporting block protrudes backwards from the notch, for the second connecting portion to press forwards.

Furthermore, the protruding block extends backwards from the supporting block.

Furthermore, at least one rabbet is recessed forwards from the supporting block, and the first connecting portion is pressed forwards and is correspondingly received in the rabbet.

Furthermore, the first connecting portion includes a vertical first section, a vertical second section and the bending section located between the first section and the second section, the rabbet includes a first rabbet and a second rabbet, for correspondingly receiving the first section and the second section respectively, and the first rabbet and the second rabbet are separated from each other.

Furthermore, at least one third receiving hole and at least two fourth receiving holes are opened forwards from the notch, a third contact portion extends forwards from the first connecting portion and is located in the third receiving hole, and a fourth contact portion extends forwards from the second connecting portion and is located in one of the fourth receiving holes.

Furthermore, a first card slot is opened at a front side of the electrical connection base and is at least in partial connection with the first receiving hole and the second receiving hole, a second card slot is opened at the front side of the electrical connection base and is at least in partial connection with the third receiving hole and the fourth receiving hole, a contact extends forwards from the first contact portion and the second contact portion respectively and enters the first card slot, and a contact extends forwards from the third contact portion and the fourth contact portion and enters the second card slot.

Furthermore, the first card slot and the second card slot are arranged in an upper-lower manner.

Furthermore, a first retaining slot and at least two second retaining slots are recessed forwards from the supporting block, a first retaining portion extends forwards from the first connecting portion and is located in the first retaining slot, and a second retaining portion extends forwards from the second connecting portion and is located in the second retaining slot.

Furthermore, the first retaining portion and the first retaining slot are in interference fit, and the second retaining portion and the second retaining slot are in interference fit.

As compared with the prior art, in the electrical connector of the present invention, as the second connecting portions are correspondingly located at two sides of the protruding block respectively, the protruding block can protect the second terminal and prevent the second connecting portion from deflecting. Moreover, as the first connecting portion is bent backwards along the periphery of the protruding block to form the bending section, the bending section of the first connecting portion and the second connecting portion are staggered with each other, thus avoiding short circuit caused by contact of the bending section of the first connecting portion with the second connecting portion. As the first connecting portion is bent backwards along the periphery of the protruding block to form the bending section, a gap for forming the protruding block is reserved by the bending section, so a clearance reserved between two adjacent second connecting portions for forming the protruding block is larger than that in the prior art, and the thickness of the protruding block is at least doubled, as compared with that in the prior art. Therefore, when the second terminal deflects and shakes laterally due to a large external force, the protruding block is not easily broken even being impacted by the second connecting portion, thus effectively ensuring the functions of the protruding block of protecting terminals, isolating the first connecting portion from the second connecting portion and avoiding short circuit between the first connecting portion and the second connecting portion.

Additionally, as the supporting block protrudes backwards from the notch, the rabbet is recessed forwards from the supporting block, and the first connecting portion is pressed forwards and is received in the rabbet, the first connecting portion and the second connecting portion are staggered in a front-rear manner, thus avoiding short circuit caused by contact of the bending section of the first connecting portion with the second connecting portion. The side wall of the rabbet can protect and position the first connecting portion, thereby effectively preventing the first connecting portion from deflecting.

DETAILED DESCRIPTION OF THE INVENTION

Figure 1:
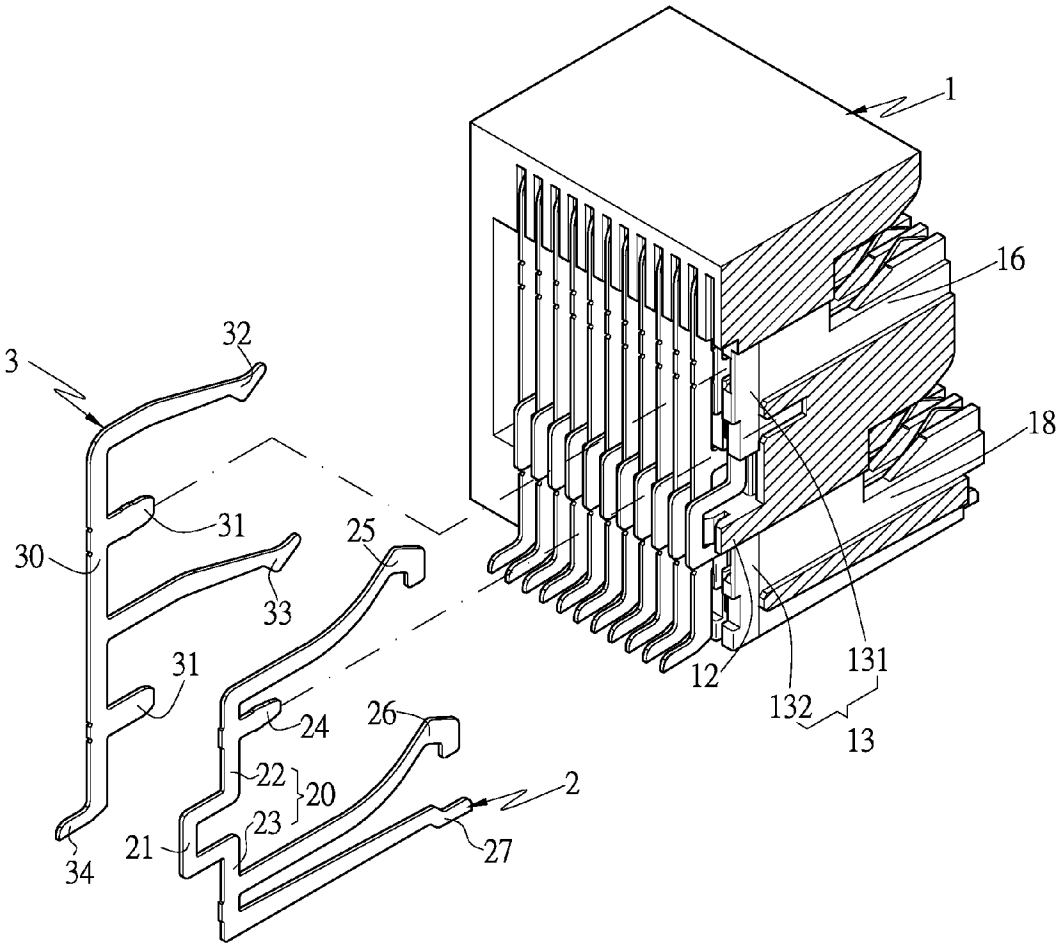
FIG. 1 is a perspective exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, FIGS. 1-7, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention. Additionally, some terms used in this specification are more specifically defined below.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

Unless otherwise defined, all technical and scientific terms used herein have the same meaning as commonly understood by one of ordinary skill in the art to which this invention pertains. In the case of conflict, the present document, including definitions will control.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" means two or more.

As used herein, the terms "comprising," "including," "carrying," "having," "containing," "involving," and the like are to be understood to be open-ended, i.e., to mean including but not limited to.

As shown in FIG. 1, the electrical connector of the present invention includes an electrical connection base 1, in which multiple first terminals 2 and multiple second terminals 3 are received in the electrical connection base 1, and the first terminals 2 and the second terminals 3 are arranged at an interval.

Figure 2:
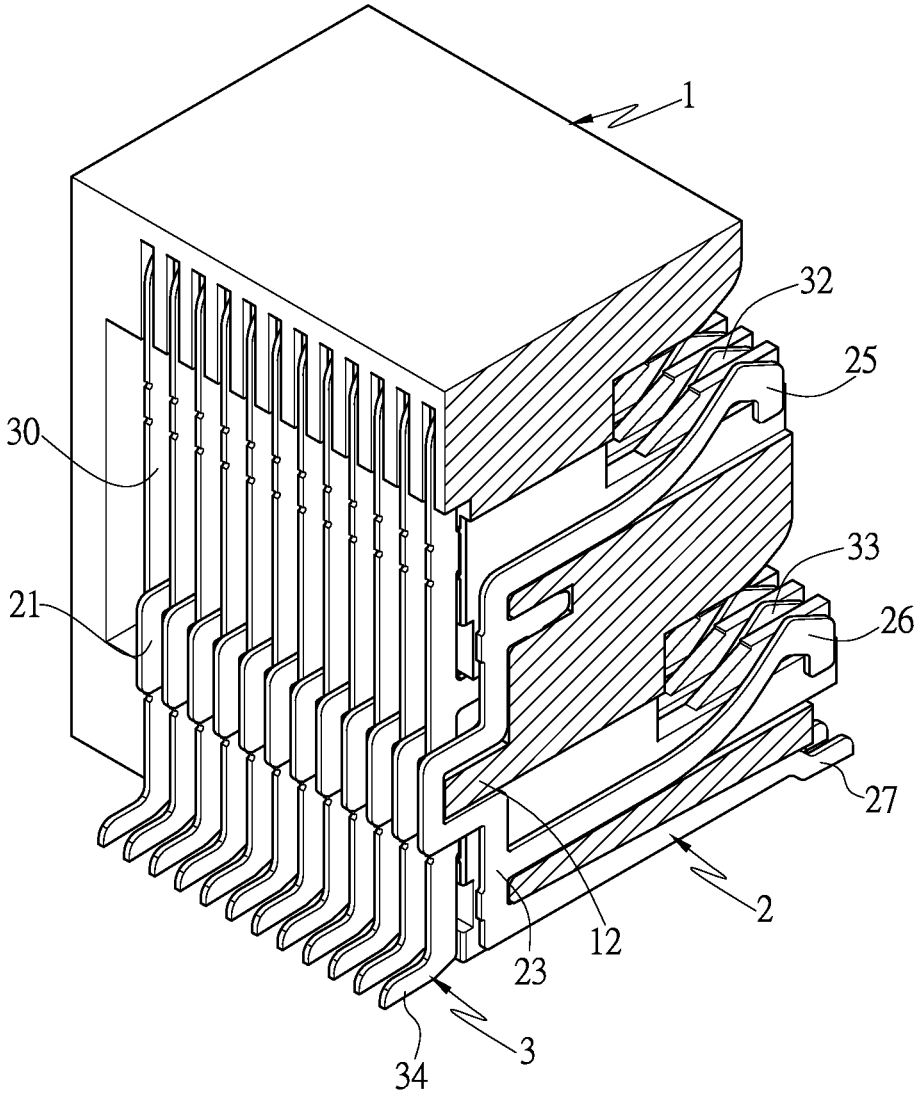
FIG. 2 is a perspective assembled view of the electrical connector according to one embodiment of the present invention.
Figure 3:
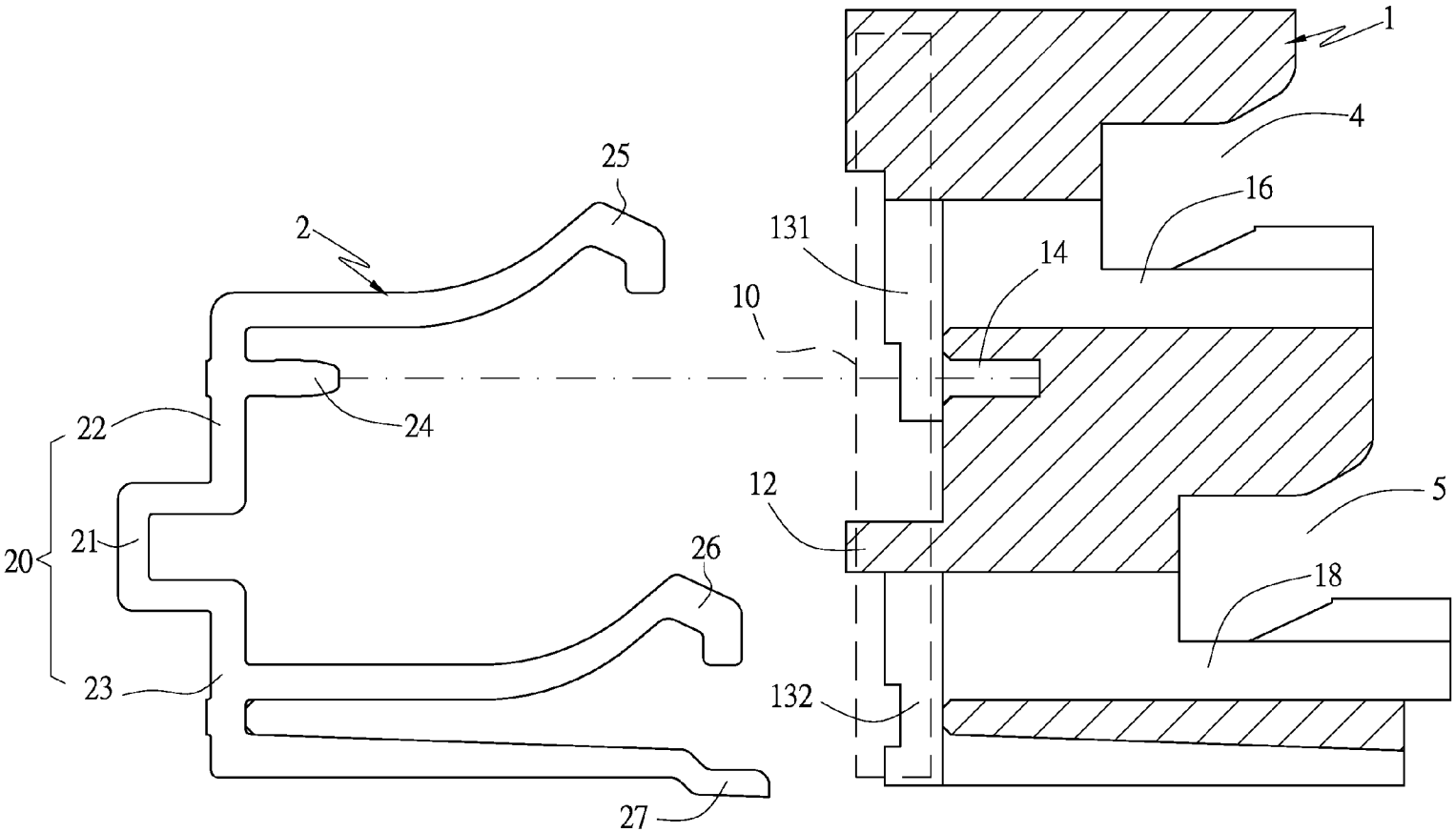
FIG. 3 is a cross-sectional view of the electrical connector after a first terminal is detached from an electrical connection base according to one embodiment of the present invention.

Referring to FIG. 2 and FIG. 3, the electrical connection base 1 is in an elongated shape, and is fixed on a circuit board (not shown). A notch 10 is opened at a rear side of the electrical connection base 1, and at least one supporting block 11 protrudes backwards from the notch 10. In this embodiment, the supporting block 11 includes two supporting blocks, that is, a first supporting block 111 and a second supporting block 112 shown in FIG. 5, and the first supporting block 111 and the second supporting block 112 are arranged in an upper-lower manner and are not connected to each other.

At least one protruding block 12 protrudes backwards from the notch 10, and as a preferred implementation, multiple protruding blocks 12 extend backwards from the second supporting block 112. A clearance exists between two adjacent protruding blocks 12.

Figure 5:
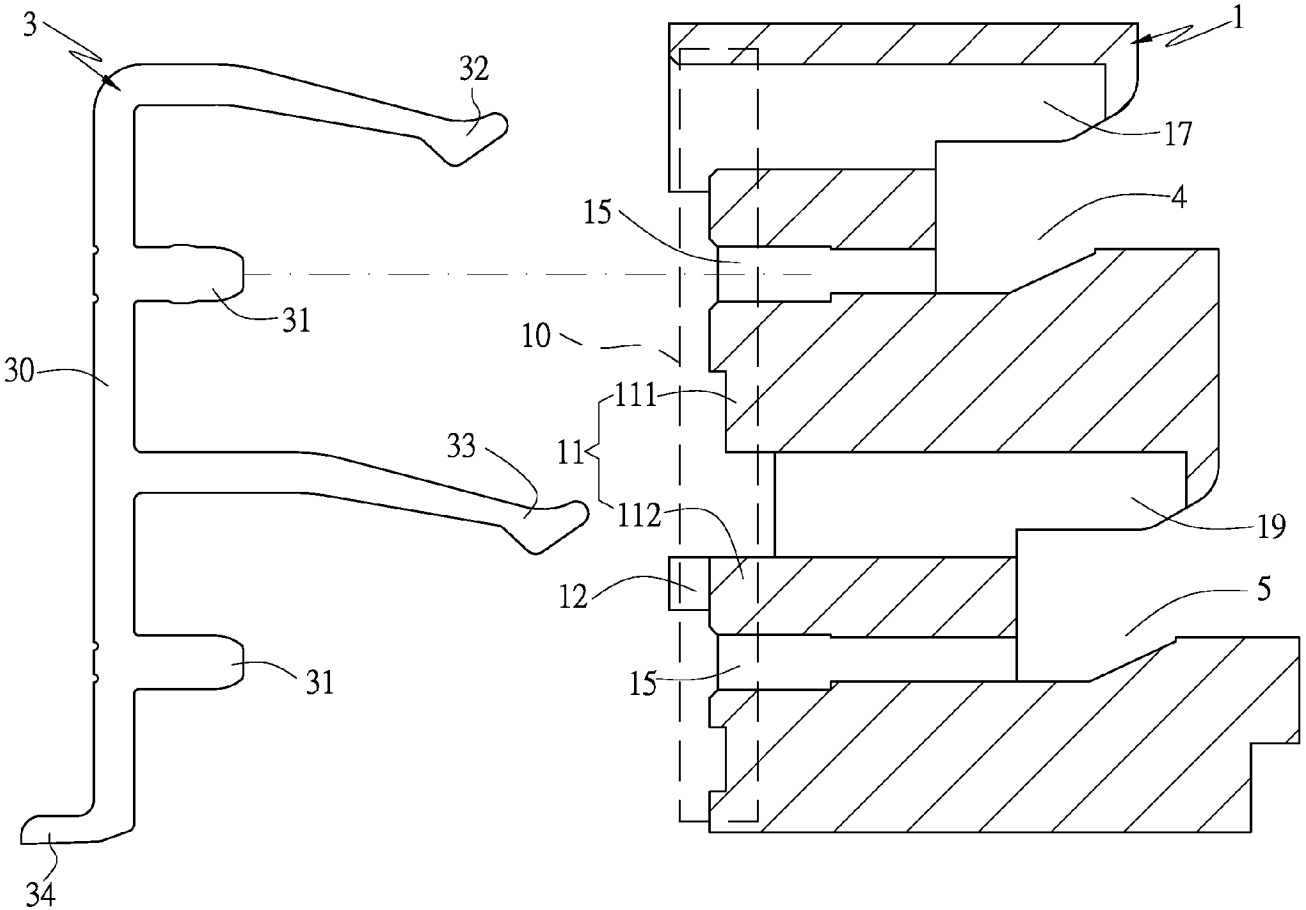
FIG. 5 is a cross-sectional view of the electrical connector after a second terminal is detached from the electrical connection base according to one embodiment of the present invention.

Referring to FIG. 1, FIG. 3 and FIG. 5, at least one rabbet 13 is recessed forwards from the supporting block 11, and as a preferred implementation, the number of the rabbet 13 is corresponding to the number of the first terminal 2. Each of the rabbets 13 includes a first rabbet 131 and a second rabbet 132, and the first rabbet 131 and the second rabbet 132 are isolated from each other by the protruding block 12. The first rabbet 131 is recessed forwards from the first supporting block 111, and is located above the protruding block 12. The first rabbet 131 and the notch 10 are in partial connection, and the first rabbet 131 is located in front of the notch 10, that is, the position of the first rabbet 131 (from rear to front) is deeper than that of the notch 10. The second rabbet 132 is recessed forwards from the second supporting block 112 and is located below the protruding block 12, and the second rabbet 132 may be disposed at a position deeper than that of the notch 10 (located in front of the notch 10), and definitely, may also be disposed at a position shallower than that of the notch 10 (that is, located behind the notch 10).

A first retaining slot 14 and at least two second retaining slots 15 are recessed forwards from the supporting block 11, and the first retaining slot 14 and the second retaining slots 15 are staggered in an upper-lower manner. In this embodiment, the number of the first retaining slot 14 is corresponding to that of the first terminal 2, and the number of the second retaining slot 15 is corresponding to that of the second terminal 3.

At least one first receiving hole 16 and at least two second receiving holes 17 are opened forwards from the notch 10, and the at least two second receiving holes 17 are located at two sides of the first receiving hole 16. At least one third receiving hole 18 and at least two fourth receiving holes 19 are opened forwards from the notch 10. The at least two fourth receiving holes 19 are located at two sides of the third receiving hole 18.

A first card slot 4 and a second card slot 5 are opened at the front side of the electrical connection base 1, for inserting a first electronic card (not shown) and a second electronic card (not shown) respectively, and the first card slot 4 and the second card slot 5 are arranged in an upper-lower manner. The first card slot 4 is at least in partial connection with the first receiving hole 16 and the second receiving hole 17 respectively, and the second card slot 5 is at least in partial connection with the third receiving hole 18 and the fourth receiving hole 19.

Figure 4:
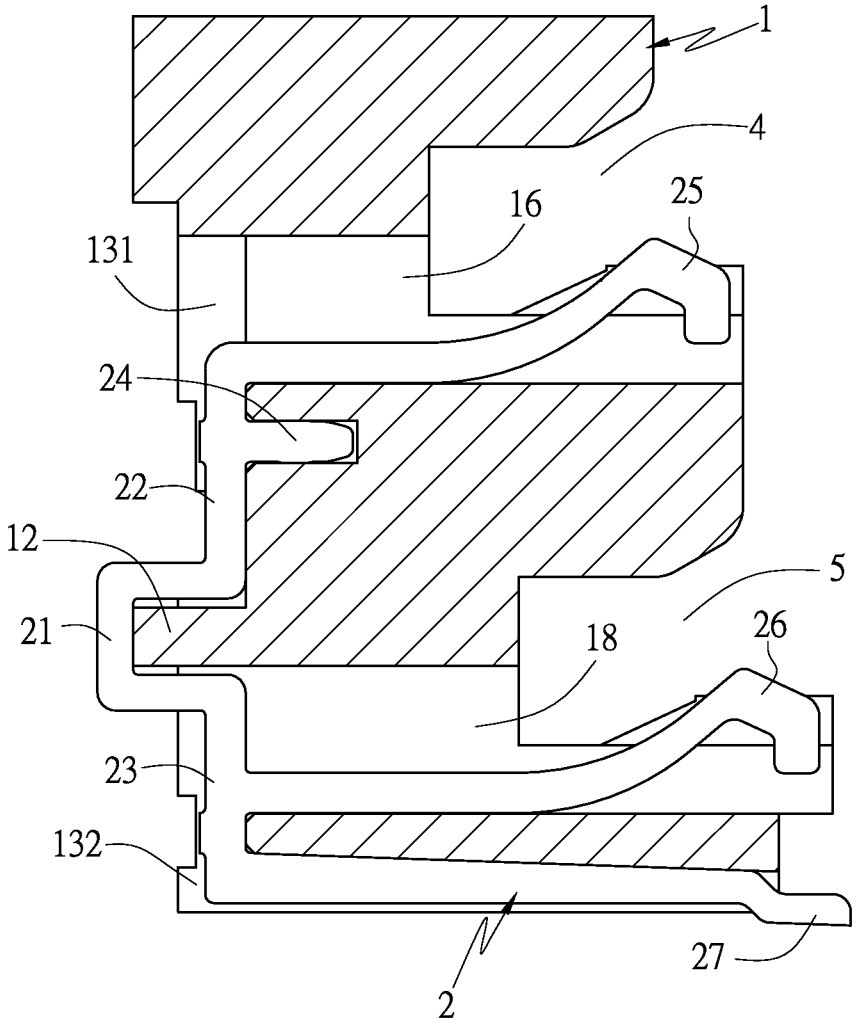
FIG. 4 is a cross-sectional view of the electrical connector after the first terminal is assembled in the electrical connection base according to one embodiment of the present invention.

Referring to FIG. 3 and FIG. 4, each of the first terminals 2 has a vertical first connecting portion 20, correspondingly disposed in the notch 10, and the first connecting portion 20 is bent backwards along a periphery of the protruding block 12 to form a bending section 21. Specifically, the first connecting portion includes a vertical first section 22, a vertical second section 23, and the bending section 21 located between the first section 22 and the second section 23. The first section 22 is pressed forwards and is received in the first rabbet 131, the second section 23 is pressed forwards and is received in the second rabbet 132, and the bending section 21 is pressed against a surface of the protruding block 12. Additionally, a first retaining portion 24 extends from the first section 22 of the first connecting portion 20 and is located in the first retaining slot 14, and the first retaining portion 24 and the first retaining slot 14 are in interference fit. A first contact portion 25 extends forwards from the first section 22 and is located in the first receiving hole 16, a third contact portion 26 extends forwards from the second section 23 and is located in the third receiving hole 18, a contact extends forwards from the first contact portion 25 and enters the first card slot 4, and a contact extends forwards from the third contact portion 26 and enters the second card slot 5. A first soldering portion 27 extends forwards from a bottom end of the second section 23, and a part of the first soldering portion 27 is exposed on a bottom surface of the electrical connection base 1.

Figure 6:
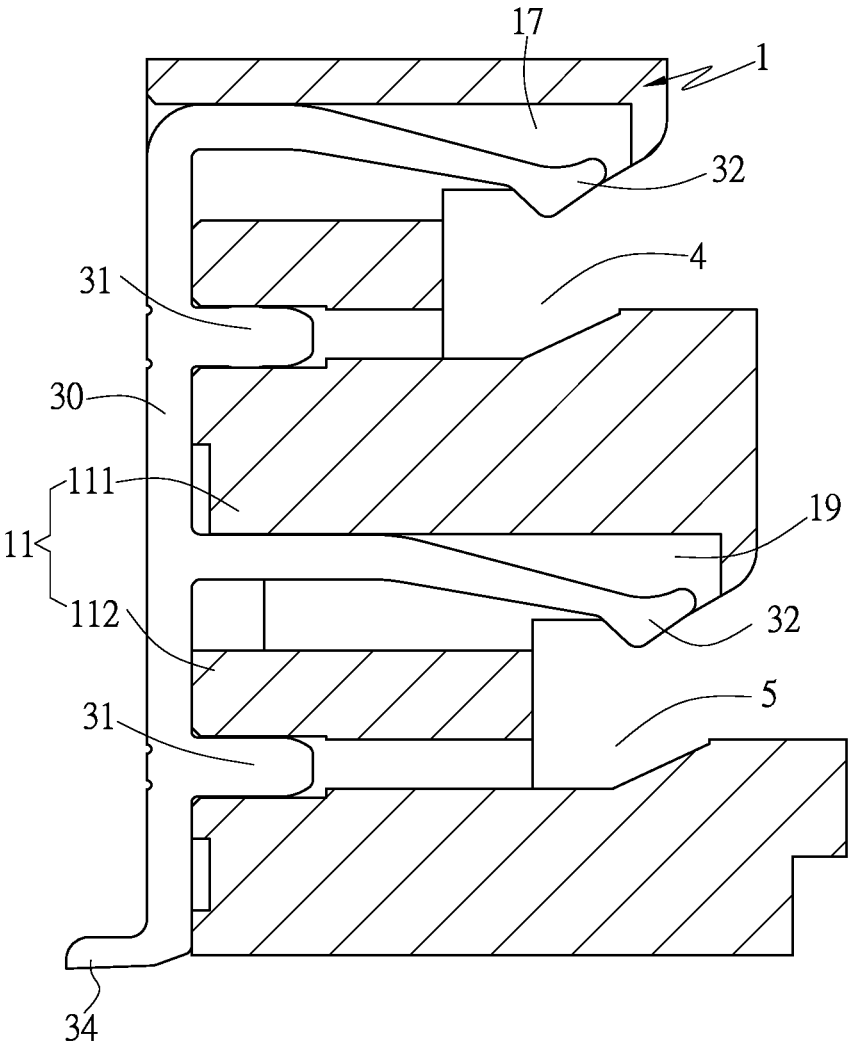
FIG. 6 is a cross-sectional view of the electrical connector after the second terminal is assembled in the electrical connection base according to one embodiment of the present invention.

Referring to FIG. 5 and FIG. 6, each of the second terminals 3 has a vertical second connecting portion 30, correspondingly disposed in the notch 10, and the second connecting portions 30 of the two second terminals 3 are correspondingly located at two sides of the protruding block 12, that is, each of the second connecting portions 30 is located in the clearance between two adjacent protruding blocks 12, and the second connecting portion 30 is pressed forwards against the supporting block 11. Two second retaining portions 31 extend forwards from the second connecting portion 30 and are located in the second retaining slots 15, and the second retaining portion 31 and the second retaining slot 15 are in interference fit. A second contact portion 32 extends forwards from an upper end of the second connecting portion 30 and is located in the second receiving hole 17. A fourth contact portion 33 extends forwards from a lower end of the second connecting portion 30 and is located in one of the fourth receiving holes 19. A contact extends forwards from the first contact portion 25 and enters the first card slot 4, and a contact extends forwards from the third contact portion 26 and enters the second card slot 5. A second soldering portion 34 extends backwards from a bottom end of the second connecting portion 30, and a part of the second soldering portion 34 is lower than the bottom surface of the electrical connection base 1.

Figure 7:
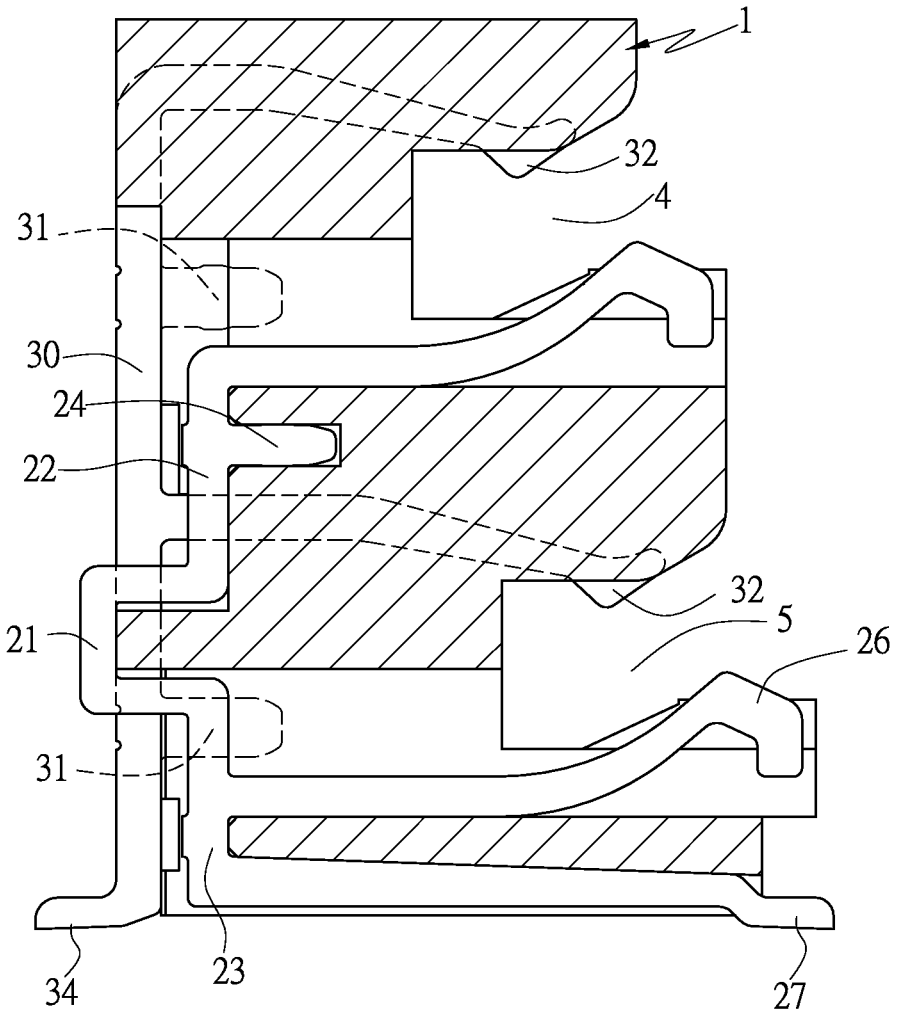
FIG. 7 is a cross-sectional view of the electrical connector after assembly according to one embodiment of the present invention.

During assembling the electrical connector of the present invention, referring to FIG. 3 and FIG. 4, the first terminal 2 is inserted into the notch 10 from rear to front from the rear side of the electrical connection base 1, so that the first connecting portion 20 correspondingly penetrates into the rabbet 13, and the first contact portion 25, the third contact portion 26 and the first retaining portion 24 correspondingly enter the first receiving hole 16, the third receiving hole 18 and the first retaining slot 14. Similarly, referring to FIG. 5 and FIG. 6, the second terminal 3 is inserted into the notch 10 from rear to front from the rear side of the electrical connection base 1, so that the second contact portion 32, the fourth contact portion 33 and the second retaining portion 31 correspondingly enter the second receiving hole 17, the fourth receiving hole 19 and the second retaining slot 15. The electrical connector after assembly is as shown in FIG. 7.

The electrical connector of the present invention has the following beneficial effects.

1. As the second connecting portions 30 are correspondingly located at two sides of the protruding block 12 respectively, the protruding block 12 can protect the second terminal 3 and prevent the second connecting portion 30 from deflecting.

2. As the first connecting portion 20 is bent backwards along the periphery of the protruding block 12 to form the bending section 21, the bending section 21 of the first connecting portion 20 and the second connecting portion 30 are staggered with each other, thus avoiding short circuit caused by contact of the bending section 21 of the first connecting portion 20 with the second connecting portion 30.

3. As the first connecting portion 20 is bent backwards along the periphery of the protruding block 12 to form the bending section 21, a gap for forming the protruding block 12 is reserved by the bending section 21, so a clearance reserved between two adjacent second connecting portions 30 for forming the protruding block 12 is larger than that in the prior art, and the thickness of the protruding block 12 is at least doubled, as compared with that in the prior art. Therefore, when the second terminal 3 deflects and shakes laterally due to a large external force, the protruding block 12 is not easily broken even being impacted by the second connecting portion 30, thus effectively ensuring the functions of the protruding block 12 of protecting terminals, isolating the first connecting portion 20 from the second connecting portion 30 and avoiding short circuit between the first connecting portion 20 and the second connecting portion 30. Meanwhile, as the bending section 21 is disposed in the structure to reserve a clearance for forming the protruding block 12 with enough strength, the distance between the adjacent first terminal 2 and second terminal 3 may be set to be smaller, so that the terminals of the electrical connector can be arranged more compact, so as to enable the electrical connector to meet the high requirements for miniaturization and data transmission.

4. As the supporting block 11 protrudes backwards from the notch 10, the rabbet 13 is recessed forwards from the supporting block 11, and the first connecting portion 20 is pressed forwards and is received in the rabbet 13, the first connecting portion 20 and the second connecting portion 30 are staggered in a front-rear manner, thus avoiding short circuit caused by contact of the bending section 21 of the first connecting portion 20 with the second connecting portion 30. The side wall of the rabbet 13 can protect and position the first connecting portion 20, thereby effectively preventing the first connecting portion 20 from deflecting.

While there has been shown several and alternate embodiments of the present invention, it is to be understood that certain changes can be made as would be known to one skilled in the art without departing from the underlying scope of the present invention as is discussed and set forth above and below including claims. Furthermore, the embodiments described above and claims set forth below are only intended to illustrate the principles of the present invention and are not intended to limit the scope of the present invention to the disclosed elements.

What is claimed is:

1. An electrical connector, comprising:

(a) an electrical connection base, wherein a notch is opened at a rear side of the electrical connection base, at least one protruding block protrudes backwards from the notch, at least one first receiving hole and at least two second receiving holes are opened forwards from the notch, and the at least two second receiving holes are located at two sides of the first receiving hole;

(b) at least one first terminal having a vertical first connecting portion correspondingly disposed in the notch, wherein the first connecting portion is bent backwards along a periphery of the protruding block to form a bending section, and a first contact portion extends forwards from the first connecting portion and is located in the first receiving hole; and (c) at least two second terminals, each having a vertical second connecting portion correspondingly disposed in the notch, wherein the second connecting portions of the two second terminals are correspondingly located at two sides of the protruding block, and a second contact portion extends forwards from the second connecting portion and is located in one of the second receiving holes.

2. The electrical connector according to claim 1, wherein at least one supporting block protrudes backwards from the notch, for the second connecting portion to press forwards.

3. The electrical connector according to claim 2, wherein the protruding block extends backwards from the supporting block.

4. The electrical connector according to claim 2, wherein at least one rabbet is recessed forwards from the supporting block, and the first connecting portion is pressed forwards and is correspondingly received in the rabbet.

5. The electrical connector according to claim 4, wherein the first connecting portion comprises a vertical first section, a vertical second section and the bending section located between the first section and the second section, the rabbet comprises a first rabbet and a second rabbet, for correspondingly receiving the first section and the second section respectively, and the first rabbet and the second rabbet are separated from each other.

6. The electrical connector according to claim 1, wherein at least one third receiving hole and at least two fourth receiving holes are opened forwards from the notch, a third contact portion extends forwards from the first connecting portion and is located in the third receiving hole, and a fourth contact portion extends forwards from the second connecting portion and is located in one of the fourth receiving holes.

7. The electrical connector according to claim 6, wherein a first card slot is opened at a front side of the electrical connection base and is at least in partial connection with the first receiving hole and the second receiving hole, a second card slot is opened at the front side of the electrical connection base and is at least in partial connection with the third receiving hole and the fourth receiving hole, a contact extends forwards from the first contact portion and the second contact portion respectively and enters the first card slot, and a contact extends forwards from the third contact portion and the fourth contact portion and enters the second card slot.

8. The electrical connector according to claim 7, wherein the first card slot and the second card slot are arranged in an upper-lower manner.

9. The electrical connector according to claim 1, wherein a first retaining slot and at least two second retaining slots are recessed forwards from the supporting block, a first retaining portion extends forwards from the first connecting portion and is located in the first retaining slot, and a second retaining portion extends forwards from the second connecting portion and is located in the second retaining slot.

10. The electrical connector according to claim 9, wherein the first retaining portion and the first retaining slot are in interference fit, and the second retaining portion and the second retaining slot are in interference fit.

* * * * *